United States Patent [19]

Meadows et al.

[11] 4,255,037

[45] Mar. 10, 1981

[54] HIGH SPEED, LOW TEMPERATURE AND PRESSURE DIAZO PROCESSING APPARATUS

[75] Inventors: John W. Meadows, Los Altos; Robert J. Ritter, Mountain View, both of Calif.

[73] Assignee: Quantor Corporation, Mountain View, Calif.

[21] Appl. No.: 897,081

[22] Filed: Apr. 17, 1978

Related U.S. Application Data

[63] Continuation-in-part of Ser. No. 862,720, Dec. 27, 1977, Pat. No. 4,150,992.

[51] Int. Cl.³ ..... G03D 7/00

[52] U.S. Cl. ..... 354/299; 354/300; 34/155; 34/242

[58] Field of Search ..... 354/299, 300, 319, 324; 34/23, 26, 36, 37, 155, 242

[56] References Cited

U.S. PATENT DOCUMENTS

| | | | |
|---|---|---|---|
| 1,861,329 | 5/1932 | Uhlich et al. | 354/300 |
| 2,009,962 | 7/1935 | Kurten | 354/300 |
| 2,667,826 | 2/1954 | Martlin | 354/300 |
| 2,761,364 | 9/1956 | Cross | 354/300 |
| 3,147,687 | 9/1964 | Halden | 354/300 |
| 3,364,833 | 1/1968 | Mulvany | 354/300 |
| 3,411,906 | 11/1968 | Boone et al. | 96/49 |
| 3,435,751 | 4/1969 | Goodman et al. | 34/242 |
| 3,440,944 | 4/1969 | Endermann et al. | 354/299 |
| 3,570,383 | 3/1971 | Berg | 354/300 |
| 3,589,810 | 6/1971 | Umahashi et al. | 354/300 |
| 4,019,193 | 4/1977 | Holman et al. | 354/300 |
| 4,056,824 | 11/1977 | Iiyama et al. | 354/300 |
| 4,068,249 | 1/1978 | Degenhardt et al. | 354/300 |
| 4,109,268 | 8/1978 | Schroter et al. | 354/300 |

*Primary Examiner*—L. T. Hix
*Assistant Examiner*—Alan Mathews
*Attorney, Agent, or Firm*—J. T. Cavender; Wilbert Hawk, Jr.; George J. Muckenthaler

[57] ABSTRACT

A processor for developing diazo film defined by a pair of flat platens disposed within a housing and spaced apart a distance only slightly greater than the thickness of the film. The housing includes intake and outlet openings aligned with the space between the platens and means for advancing an incoming film from the intake opening, through the space between the platens and for discharging it through the outlet opening. The platen facing the emulsion side of the film is heated and includes at least one passage through which a metered amount of aqueous ammonia is passed for each film that is to be developed. The ammonia is vaporized in the passage and discharged against the emulsion side of the film. A transverse groove in the emulsion facing surface of the platen communicates with the passage to distribute the ammonia vapor over the full width of the film. The developing temperature is between about 150°-200° F., the ammonia vapor pressure does not substantially exceed atmospheric pressure and developing times are not more than a few seconds.

22 Claims, 6 Drawing Figures

HIGH SPEED, LOW TEMPERATURE AND PRESSURE DIAZO PROCESSING APPARATUS

RELATED APPLICATIONS

This is a Continuation-in-Part Application of the co-pending patent application bearing Ser. No. 862,720, filed Dec. 27, 1977, now U.S. Pat. No. 4,150,992, issued Apr. 24, 1979 and entitled HIGH SPEED, LOW TEMPERATURE AND PRESSURE DIAZO PROCESSING METHOD AND APPARATUS.

BACKGROUND OF THE INVENTION

Diazo sensitized papers have been used for a long time for making duplicate copies of originals, normally by contact printing and the subsequent development of the exposed diazo paper in an aqueous ammonia vapor atmosphere. In such an application, resolution requirements and development times are not critical. More recently diazo sensitized films have received increasing attention as an ideal medium for making microfilm or microfiche masters and, perhaps more importantly, duplicates thereof because of the relatively low cost of such film, its high resolution capability, etc. For such applications, however increasingly stringent demands are made on the film developing process, particularly as to the speed with which it can be accomplished so as to enable an efficient, high volume production of diazo film copies from a master, for example.

In this regard, problems have been encountered in the past. In order to attain short development times for diazo film, it was heretofore thought necessary that the development takes place in a high pressure ammonia atmosphere. In general, the pressures that were considered necessary are substantially above, e.g. several times the atmospheric pressure and they ranged up to as high as 1,000 psi or more. For example, U.S. Pat. No. 3,411,906 speaks of ammonia pressures in the range of between 50 and 1,000 psi. Little attention was paid to the actual design of the developing chamber into which the ammonia is introduced other than to maintain the volume relatively small for the obvious expedient of limiting the amount of ammonia that is expended in the developing process.

From a practical view, however, such high pressure requirements represent severe drawbacks, particularly in connection with a continuously operating diazo film developer since the exposed film must be transported from the exterior into the high pressure atmosphere. For one, ammonia leakage is quite unacceptable because of its noxious odor and the potential health hazard it represents if present in appreciable concentrations. Further, it is notoriously difficult to seal a pressurized chamber if continuous access to its interior is required unless the ammonia in the chamber is evacuated each time a film is inserted therein or withdrawn therefrom. This, however, is not compatible with a high speed, high volume operation.

Although the above-referenced U.S. patent does not concern itself with the actual chamber construction and is not concerned with the above summarized difficulties of operating it, another U.S. patent (No. 3,364,833) proposes the construction of a diazo film developing device comprising a sealed chamber defined by a base having a cavity dimensioned to receive the film and a cover that is bolted and sealed against the base. The space of the cavity is kept as small as possible and once it is sealed, the air therein is evacuated and replaced with high pressure ammonia to develop the film. Although this device no doubt assures the full and complete development of the film and, if operated along the lines suggested in the earlier referenced U.S. patent yields short development times, the insertion and removal of the film from the cavity must be manually performed and surely exceeds the development time for the film by a very large factor. Thus, the device disclosed in U.S. Pat. No. 3,364,833 may be ideally suited for developing an individual diazo film from time-to-time; but it is unsuitable for continuous, large volume operations.

Thus, inspite of the advantages afforded by diazo film for high resolution, high volume applications such as for the duplication of microfiche masters, there is presently no technologically feasible device for economically mass developing such film.

SUMMARY OF THE INVENTION

The present invention provides a diazo film developing apparatus which dramatically departs from prior art concepts for the construction and operation of diazo film developers to render them compact, efficient and easy to operate at even very high film output volumes. This is accomplished by dispensing with the high ammonia pressures heretofore thought necessary to achieve short developing times. Instead, in accordance with the present invention, the film is developed in aqueous ammonia vapor at a pressure which does not substantially exceed atmospheric pressure. For purposes of the present invention, this means that the pressure is only slightly higher than atmospheric pressure, by an amount no more than that required to introduce the vapor into the developing chamber. Thus, the pressure is typically in the area of no more than a few, say 1 to 2 inches of water column above atmospheric pressure and in any event, it is substantially less than the heretofore suggested ammonia pressures and, therefore, will always be less than one atmosphere (about 14 psi) above atmospheric pressure.

This low pressure ammonia vapor is combined with a minimal developing chamber volume which is no greater than that required to conveniently pass a film to be developed through the chamber. The low pressure ammonia vapor and small developing chamber volume is further coupled with relatively low operating temperatures in a range of between about 150° F. to 200° F. and, preferably, between about 175° F. to 190° F. so that emulsion layer on the film is not softened by heat. In this manner, moving contact between the film and in particular its emulsion and components of the chamber will not damage the emulsion. This facilitates the minimization of the developing chamber volume since an actual contact between the moving film emulsion and chamber walls does not adversely affect the images on the film. In fact, applicants presently believe that such a moving contact between the emulsion and chamber walls, at least so long as it takes place intermittently, enhances the development of the film by more intimately subjecting the emulsion to the ammonia vapor and removing from the emulsion any expended ammonia.

Thus, in general terms the present invention contemplates to form a developing chamber which is defined by first and second, parallel surfaces, the spacing between them being maintained so that it only slightly exceeds the thickness of the film to enable the passage of the film between the surfaces. In a practical embodiment such as spacing is normally between about two to about eight times the film thickness, with a spacing of about 0.020" being presently preferred because of the ease with which the component making up the chamber can be manufactured, the ease with which the film can be transported between the surfaces in actual use, and the relatively very low volume exhibited by a chamber having such dimensions.

Further, the present invention contemplates that the film is advanced in a downstream direction through the chamber at a speed so that the stay time for (any part of) the film does not substantially exceed a few seconds, say five seconds and, preferably, so that the stay time is no more than about one or two seconds. Aqueous ammonia is introduced into the chamber from the chamber surface which faces the emulsion side of the film. The ammonia vapor is of substantially atmospheric pressure, that is it is only slightly, e.g. a few inches of water column above atmospheric pressure.

The vaporization and (minimal) pressurization of the ammonia is achieved by providing a heated platen which defines the surface that faces the emulsion side of the film and forming an open conduit therein which extends through the film facing surface of the platen. The platen is heated to the above-stated developing temperature and aqueous ammonia is flowed into the conduit where it is vaporized due to the elevated temperature. This results in the above-discussed slight rise in the ammonia vapor pressure of a few inches of water column so that the vapor discharges from the conduit into the chamber. In a preferred embodiment of the invention, a metered amount of aqueous ammonia is pumped into the conduit for each film to be developed. This can be done by using an appropriately designed pump or by sensing an approaching film and intermittently actuating a metered aqueous ammonia pump in response thereto.

The above summarized developing method is performed with apparatus of the present invention which, generally speaking, comprises a housing that defines an upstream film intake opening and a downstream film outlet opening. First and second platens are disposed within the housing and opposing, parallel first and second surfaces of the platens are positioned to receive incoming film from the intake opening and to discharge outgoing film to the outlet opening. Means is further provided for maintaining the spacing between the platens in the above-outlined range so as to permit the uninhibited passage of the film between the surfaces while minimizing the spacing between the surfaces and, therefore, the volume of the developing chamber defined by the space between the platens. Pairs of cooperating rollers advance the film (with its emulsion side facing the first surface) in a downstream direction from the intake opening through the chamber to the outlet opening.

The present invention further provides means for sealing the developing chamber from the intake and the outlet openings. The sealing means comprise sets of cooperating, elongate, opposite rollers disposed adjacent and parallel to the openings for receiving and discharging the film. The rollers have resilient surfaces in mutual contact and low friction, e.g. Teflon (a registered Trademark of the Dupont de Nemours Company) strips are sealingly disposed in corresponding grooves of the housing, are arranged parallel to the rollers, and are resiliently biased thereagainst so as to form a seal therewith and prevent the escape of ammonia vapors through the openings to the exterior. Although such a seal would not be sufficient to withstand the high ammonia pressures found in prior art diazo film developing systems, it is sufficient to form a seal during the low pressure operation of the apparatus of the present invention so that no noxious ammonia odors escape. Consequently, a device constructed in accordance with the invention can be operated in closed rooms with little or no separate ventilation without representing a health hazard or creating an objectionable stench or odor.

Alternatively, the spring biased strips which engage the resilient roller surfaces may be replaced with relatively flexible Teflon sheets which extend over the length of each roller. One portion of the sheet is rigidly secured, e.g. bolted against a platen while the other portion of the sheet overlies the respective roller. A flexible leaf-spring is similarly bolted against the platens, preferably together with the Teflon sheet, and it is arranged so as to bias the associated sheet against the roller surface to thereby establish a seal between the developing chamber and the exterior.

Further, the apparatus of the present invention includes a heater for heating the first platen to a temperature in the above-stated range and at least one conduit is formed in the first platen, communicates with the first surface and is located proximate the upstream end thereof. Pump means supplies to the conduit aqueous ammonia and means is provided for evaporating the ammonia therein to effect a discharge of the ammonia vapor from the conduit at the above-discussed low pressure. Thus, as the diazo film advances through the developing chamber, it is contacted by the ammonia vapor and causes the formation of a turbulent ammonia vapor layer between at least portions of the emulsion and the first surface to effect the rapid developing of the emulsion at low temperatures and pressures.

The first surface preferably includes a transverse groove which fluidly communicates with the ammonia conduit to effect the distribution of the vapor over the full film width. Additional grooves downstream of the first mentioned groove enhance the developing speed believed to be at least in part caused by the increased turbulence in the ammonia vapor which is caused by such grooves.

To further enhance the developing process the film itself is preferably preheated before it enters the developing chamber. In a preferred embodiment of the invention, this is accomplished by passing the film between two platens heated to the same temperature as the first platens, and disposed upstream of the developing chamber.

From the foregoing summary, it is apparent that the present invention achieves the high speed developing of diazo-type film without having to rely on the high pressures required in prior art diazo developing systems. This, coupled with the small chamber dimensions enables the very rapid development of microfiche, often in less than one second. It conserves ammonia and, most importantly, it enables a very simple construction of the chamber and the film transport mechanism while assuring an effective seal to prevent the escape of ammonia into the surrounding atmosphere. Therefore, the present invention is ideally suited for incorporation in microfiche duplicators and its wide acceptance throughout the industry is fully anticipated.

BRIEF DESCRIPTION OF THE DRAWINGS

FIG. 1 is an overall side elevational view, in section, of a diazo film developer constructed in accordance with the present invention for incorporation in a microfiche copier or the like;

DESCRIPTION OF THE PREFERRED EMBODIMENT

Figure 1:
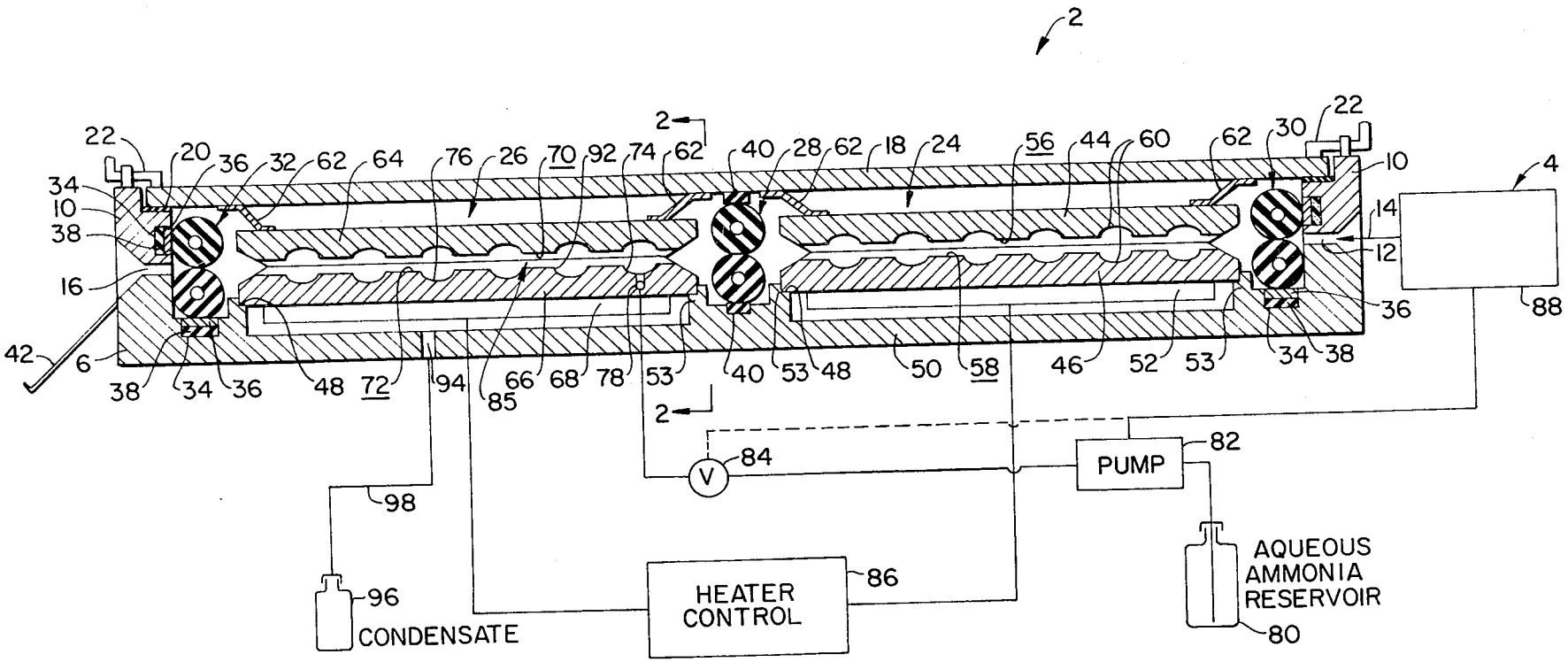

Referring to the drawings, a diazo film developer 2 may comprise part of a microfiche duplicator 4 (schematically shown only) which includes suitable means for exposing such film and for thereafter advancing it towards the developer. The developer itself generally comprises a housing 6 which has upright side walls 8 and spaced apart end walls 10 and which is normally horizontally positioned. The end walls 10 define an upstream intake opening 12 through which a microfiche 14 may enter the interior of the housing. The other, opposite end wall of the housing defines an outlet opening 16 which is aligned with the intake opening. A flat cover 18 is placed over the housing and a gasket 20 seals the interior space from the exterior. Suitable closure hinges 22 retain the cover to the housing while they assure the formation of a seal between the cover and the gasket.

In the presently preferred embodiment of the invention the housing interior is divided into a pair of serially arranged upstream and downstream cavities 24, 26 by a first pair of cylindrical, parallel drive rollers 28 positioned at about the center of the housing interior. A second and a third pair 30, 32 of like drive rollers is disposed adjacent the intake and the outlet openings, respectively. The rollers are in mutual contact along a line aligned with the center of the intake and the outlet openings, they are constructed of a resilient material and they are biased against each other so that the rollers form an airtight seal between them.

A groove 34 in the housing is adjacent and parallel to each roller of the second and third roller pairs. Each such groove receives an elongated low friction, e.g. Teflon strip 36 which is biased against the periphery of the adjacent roller by a resiliently compressible member 38 such as a foam rubber pad. The sealing engagement of the rollers themselves and their sealing engagement of the low friction strips 36, seals the housing interior from the intake and outlet openings 12, 16. The rollers are further journaled in bearings (not shown) carried by the housing side walls 8 which form a seal against the end faces of the rollers. A drive, such as a chain or sprocket drive (not shown) rotates the rollers of each pair in opposite directions so that a microfiche 14 placed between the upstream, second roller pair 30 is grasped and advanced in a downstream direction into the first, upstream housing cavity 24. Roller pair 28, which may be sealed against the housing and the cover in the above described manner with suitably placed seal strips 40, thereafter grasps the downstream moving fiche and advances it towards the third roller pair which discharges such film through outlet opening 16 into a receptacle 42. It will be noted that during this transport of the film the housing interior remains fully sealed irrespective of the speed and/or frequency with which fiche is fed through the developer.

Figure 2:
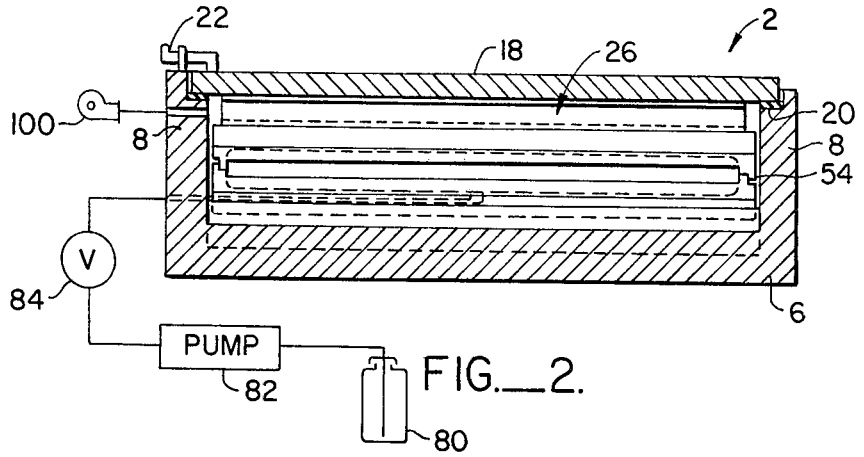
FIG. 2 is a front elevational view, in section, of the developer shown in FIG. 1 and is taken on line 2—2 of FIG. 1.

In the presently preferred embodiment of the invention the upstream cavity 24 is utilized for the preheating of microfiche 14 before it is developed in the downstream cavity 26. For this purpose, a pair of parallel, opposing upper and lower heating platens 44, 46, respectively are placed in the upstream cavity. The lower platen rests in a rectangular groove 48 on a raised frame 53 projecting from a bottom plate 50 of the housing and spaces the platen therefrom so that a plate heater 52 can be attached to the underside of the platen for heating it to the desired temperature as is further discussed below. Edges 54 (shown in FIG. 2 only) of the platens overlap, are raised and provided with interengaging grooves to maintain the platen in mutual alignment and at the desired spacing so that opposing platen surfaces 56, 58 are spaced apart a sufficient distance to permit the passage of a microfiche therebetween. In a typical embodiment, the spacing is approximately 0.02". Grooves 60 may be formed in the platen to prevent the adherence of the film to one or the other. Further, the edges are spaced apart so that the effective width of the opposing platen surfaces 44, 46 is just slightly larger than the width of the fiche 14.

A pair of generally Z-shaped leaf-springs is mounted, e.g. welded or bolted to the underside of cover 18 and, when the cover is secured to the housing, exerts a downward pressure against the upper platen 44 so as to maintain it in firm contact with the lower platen.

Figure 3:
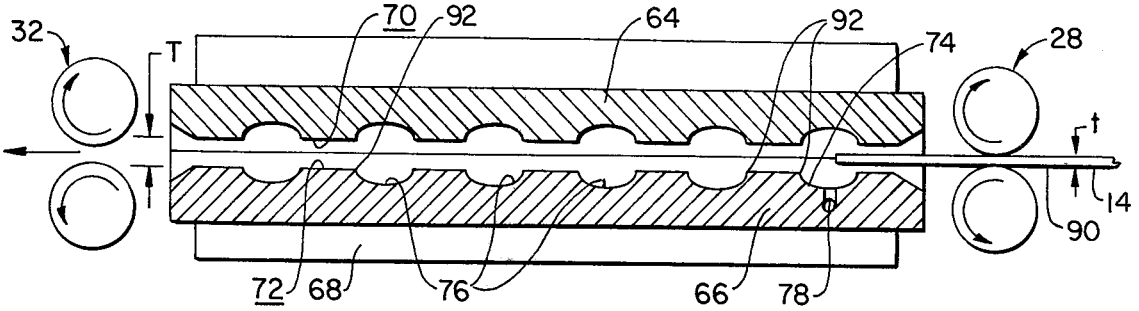
FIG. 3 is an enlarged, schematic side elevational view of the developing chamber shown in FIG. 1.

A second pair of developing platens 64, 66 is disposed in the downstream cavity 26. The construction of the developing platens is generally similar to that of heating platens 44, 46. Thus, the lower platen rests in an other rectangular groove 48 formed in a raised frame 53 so as to provide space for a heater 68 attached to the underside of the lower plate. The opposing surfaces 70, 72 of the developing platens define between them a developing chamber 85. Their spacing "T" is closely controlled and in the presently preferred embodiment is 0.02" for accommodating microfiche 14 having a thickness "t" of between 0.003 to about 0.007". At the indicated dimensions microfiche is readily transported in a downstream direction, to the left as viewed in FIGS. 1 and 3, without undesirable interference from the opposing platen surfaces.

Figure 4:
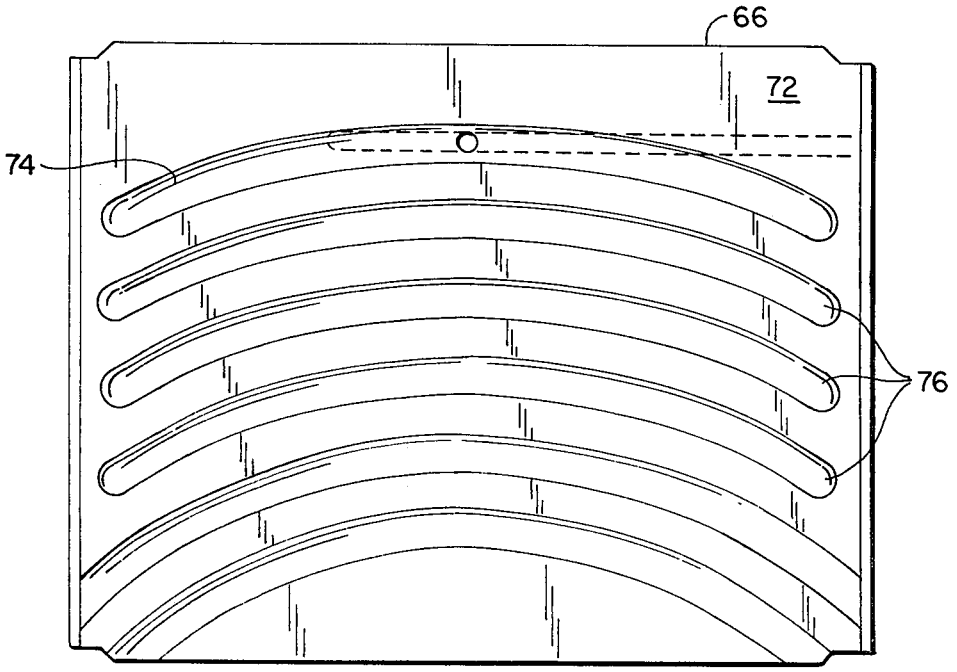
FIG. 4 is a schematic plan view of the platen defining the side of the chamber shown in FIG. 3 which faces the emulsion side of the film.

The lower platen includes a first groove 74 adjacent the upstream end of the platen which extends over the full effective width of the platen and which is convexly curved when viewed in a downstream direction, that is downwardly as seen in FIG. 4. Additional, similarly shaped grooves 76 are disposed in the lower platen and arranged downstream of groove 74. An open conduit 78 is formed in the lower platen 66 and terminates at about the bottom center of groove 74. Thus, it is also located adjacent the upstream end of the lower platen. The conduit is connected with an aqueous ammonia reservoir 80 via a metering pump 82 and a valve 84 so that upon the actuation of the pump aqueous ammonia is flowed into the conduit. The earlier mentioned Z-shaped leaf-springs 62 are employed to bias the upper developing plate 64 downwardly against the lower plate when cover 18 is closed.

Turning now to the operation of the developer 2, heater control 86 is initially actuated to energize heater 52 of the lower preheating plate 46 and heater 68 of the lower developing platen 66. In this connection, it should also be noted that a heater may also be applied to the upper platens 44 and 64 although under normal operations of the developer that is not necessary. The heater control maintains the platen temperature within the desired range, e.g. between 150° F. to 200° F. and, preferably in the vicinity of 175° F. to 190° F.

Metering pump 82 may be selected so that it pumps a very low volume of aqueous ammonia which is selected to provide just enough ammonia to develop the fiches at whatever rate they pass through the developing chamber. Alternatively, the metering pump may be an intermittently operating pump which is selectively activated in response to an approaching microfiche 14. For that purpose the microfiche duplicator 4 includes a sensor 88 (such as an optical sensor, for example) which is operatively coupled with the pump and activates the pump each time a microfiche approaches housing intake 12, for example, to flow a metered amount of aqueous ammonia to conduit 78. In an alternative operational mode the sensor 88 may be coupled with the valve 84 downstream of pump 82 to temporarily open the valve to flow the desired amount of ammonia to the conduit.

The conduit has a configuration so that ammonia is heated to about the temperature of the platen while in the conduit. This results in the evaporation of the ammonia therein and the above-discussed slight pressure build up so that ammonia vapor escapes from the end of conduit 78 which terminates in the upstreammost groove 74. When the platen is operated at the stated temperature range and the conduit has a diameter of 1/16ths inch, a conduit length within the platen of 2½ to 3 inches is sufficient to effect the desired evaporation of the ammonia.

The drive (not separately shown) for roller pairs 28, 30 and 32 may be continuously or intermittently operated, in the latter case it is suitably coupled with sensor 88.

A microfiche 14 to be developed which approaches intake opening 12 triggers sensor 88 and causes a metered amount of aqueous ammonia to be flowed to conduit 78 where it evaporates and escapes into the developing chamber for the film. Since there is a necessary lag between the introduction of aqueous ammonia to the conduit and its evaporation the pump is operated a short time period before the fiche arrives at the chamber.

Once the leading edge of the fiche is grasped by roller pair 30 the fiche is driven in a downstream direction through the space between the heating platens with its emulsion side 90 facing downwardly, that is oriented so that it faces the lower, heated platen 46. The fiche, and in particular, the emulsion carried thereon is heated to about the temperature prevailing in the developing chamber. After its leading edge issues from the downstream end of the heating platen roller pair 28 advances it into and through developing chamber 85.

Since the developing chamber has a height which is only slightly greater than the thickness of the fiche the downstream movement of the latter causes a great deal of turbulence in the ammonia vapor escaping from conduit 78 against the emulsion side of the film. Frequently, the emulsion side will either contact portions of the opposing platen surface 72 or pass closely adjacent to them to further increse the turbulence of the ammonia vapor. Additionally, as it moves over the surface and the grooves therein, the ammonia vapor therebetween retains its turbulence. It is believed that this action provides repeated access for fresh ammonia vapor to the film emulsion and significantly contributes to the high speed development. The fully developed film is then discharged from the developer into receptacle 42.

For the above-outlined developing parameters, it has been found that developing times of as little as one second, or in some instances, even less than that, can be achieved so that the film can be moved through the developer at relatively high speeds.

This is achieved with a very low pressure ammonia vapor which is readily sealed so that practically no ammonia odors are noticeable even in close proximity to the developer.

To remove ammonia condensate from the housing interior a drainage opening 94 is preferably provided beneath developing plate 66 which is connected with a condensate receptacle 96 via a hose 98 or the like. It should further be observed that by placing the Z-shaped leaf-springs 62 over the gap between the respective ends of the developing plates and the adjacent roller pairs 28, 32 any ammonia condensation which may form on the underside of cover 18 is guided along the spring onto the top developing plate, from where its flow may be guided towards drain 94 via the sides of the platens to prevent ammonia droplets from contacting the film. Further, to evacuate all ammonia vapors from the housing interior preparatory to opening cover 18, an air blower 100 is provided to force air into the interior and to thereby correspondingly force the ammonia vapors through the drainage opening 94 into condensate receptacle 96 where it can be absorbed in a suitable liquid, e.g. water bath.

Figure 5:
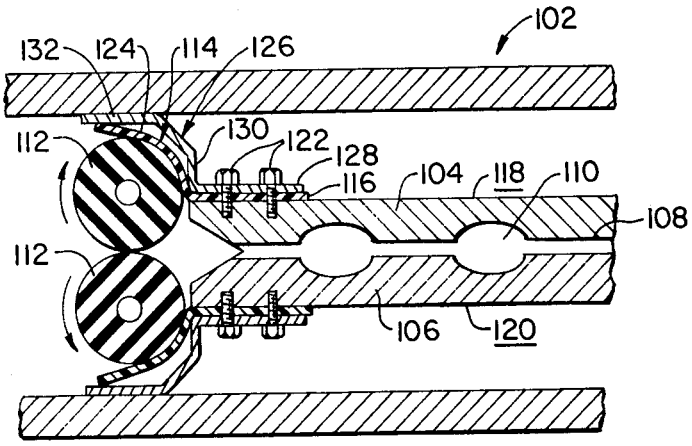
FIG. 5 is a fragmentary, side elevational view, similar to FIG. 1 and shows another embodiment of the present invention.
Figure 6:
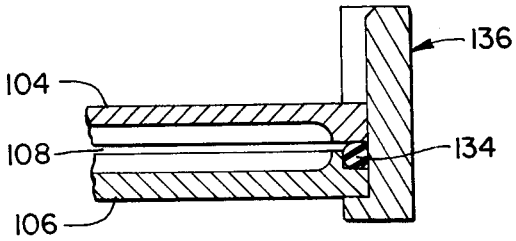
FIG. 6 is a fragmentary front elevational view illustrating the manner in which the developing chamber formed between the platens is sealed in a longitudinal direction.

Referring to FIGS. 5 and 6, in an alternative embodiment of the invention, a developer 102 again comprises a pair of opposite upper and lower platens 104, 106 which are spaced apart as above-described, e.g. 0.02 so as to form a gap 108 through which the film passes as it is being developed. The lower platen includes one or more transverse grooves 110 connected with an aqueous ammonia supply (not shown in FIGS. 5 and 6) in the above-described manner. A pair of film advancing rollers 12 is positioned adjacent the downstream end and the upstream end (not shown in FIG. 5) of the platen. The rollers are rotated in the above-described manner to grasp the film and advance it in a downstream direction.

The rollers are positioned as closely as possible to the respective ends of the platens. Instead of the earlier described seal strips, relatively thin and flexible sealing sheets 114 are provided. Each such sealing sheet has a length equal to the length of the rollers and a width so that a first portion 116 can be secured with bolts 122 to an upper side 118 of the upper platen 104 or the lower side 120 of the lower platen 106. A second portion 124 of the sealing sheet extends over the respective roller 112.

A generally Z-shaped leaf-spring 126 has a horizontal leg 128 secured to the platens with bolts 122, an upwardly extending portion 130 and a generally horizontally disposed spring arm 132 which overlies the sealing sheet portion 124 and which biases that portion into contact with and generally conforms it to the periphery of the respective roller so that there is a substantial contact area between the sealing sheet and the roller. A seal is thereby established between the developing chamber, that is between gap 108 and the space between the ends of the platens and the rollers, and the exterior. The leaf-spring 126 assures a continuous contact between the sealing sheet 114 and the roller and prevents the escape of aqueous ammonia vapors, particularly in instances in which the developing chamber is operated at the above discussed low pressures.

Further, a longitudinally extending gasket 134, which may have a circular cross-section similar to the cross-section of a standard O-ring, is placed between the upper and lower platens 104 and 106 to positively prevent the escape of ammonia vapors from the developing chamber. In this manner, the developing chamber is completely sealed, even from the surrounding housing 136 to minimize ammonia consumption, to facilitate the ease with which spent ammonia can be withdrawn from the developing chamber, and to prevent the escape of ammonia vapors upon the opening of housing cover 18 (shown in FIG. 1) without requiring separate vapor evacuation equipment such as fan 100 shown in FIG. 2.

We claim:

1. Apparatus for developing diazo film comprising means defining a developing chamber and including first and second, spaced apart, substantially parallel surfaces, a spacing between the surfaces exceeding a thickness of the film by no more than an amount required to readily move the film through the chamber; means defining an opening for introducing the film into the chamber and for removing it therefrom; means for moving the film through the opening and into and out of the chamber so that an emulsion side of the film passes immediately adjacent one of the surfaces; and means including an elongated shallow groove in the one surface for applying relatively low pressure aqueous ammonia vapor into a space between the film emulsion and the one surface; whereby a rapid, low ammonia pressure vapor developing of the emulsion is effected.

2. Apparatus according to claim 1 wherein the opening defining means defines an inlet opening adjacent one end of the chamber and a separate, spaced apart outlet opening adjacent another, opposite end of the chamber; and wherein the moving means comprises means for advancing the film through the inlet opening, the chamber and the outlet opening with the film emulsion passing in close proximity over the one surface.

3. Apparatus according to claim 2 wherein the ammonia vapor applying means includes an ammonia vapor discharge opening in the one surface and located proximate the inlet opening.

4. Apparatus according to claim 3 wherein said elongated shallow groove is in fluid communication with the discharge opening for distributing the ammonia vapor over a major portion of the width of the film passing through the chamber.

5. Apparatus according to claim 4 wherein the ammonia vapor distributing groove comprises a curved groove in the one surface fluidly communicating with the discharge opening and extending transversely to the film movement direction.

6. Apparatus according to claim 5 including additional grooves in the one surface extending transversely to the film movement and located downstream of the groove.

7. Apparatus according to claim 1 wherein the ammonia vapor applying means includes means for pressurizing the ammonia vapor to no more than a few inches of water column above atmospheric pressure.

8. Apparatus according to claim 1 including means for applying a metered amount of the ammonia vapor to the chamber for each fiche passing the chamber.

9. Apparatus for developing diazo film comprising:

first and second, spaced apart substantially parallel platens defining between them a developing chamber, the height of the developing chamber as measured by the spacing between the platens exceeding a thickness of the film by no more than an amount required to readily move the film through the chamber; a first roller pair adjacent an intake opening for the chamber and a second roller pair adjacent an outlet opening for the chamber, the roller pairs being disposed in close proximity to the platens;

spring biased means establishing a seal between the platens and the rollers of the respective roller pair;

gasket means between the platens sealing the developing chamber from the exterior and extending in the travel direction of the film through the chamber; and means including a groove extending transverse of the direction of travel of the film for applying relatively low pressure aqueous ammonia vapor into the developing chamber; whereby the film is rapidly developed in a low pressure ammonia vapor atmosphere while the escape of substantially any ammonia vapor from the chamber is prevented.

10. Apparatus according to claim 9 wherein the sealing means comprises a relatively flexible sealing sheet for each roller, the sheet having a length substantially equal to the length of the rollers, and spring means intimately biasing the sheet against the roller.

11. Apparatus according to claim 10 wherein the spring biasing means comprises means securing the sheet to the proximate platen.

12. Apparatus according to claim 11 wherein the spring biasing means includes a leaf-spring arranged to bias a portion of the sealing sheet distal from the platen into engagement with a periphery of the roller.

13. Apparatus for developing diazo film of a given width and thickness and having a substrate carrying an emulsion on a side thereof, the apparatus comprising:

a housing defining an upstream intake opening and a downstream outlet opening dimensioned to permit passage of the film therethrough;

first and second platens disposed within the housing having opposing, parallel first and second surfaces, a width slightly greater than the width of the film to permit passage of the film through a space between the surfaces, and being positioned to receive incoming film from the intake opening and to discharge outgoing film to the outlet opening;

means maintaining a spacing between the surfaces which is only slightly greater than the thickness of the film and which is selected so as to permit the uninhibited passage of the film between the surfaces while minimizing the spacing between the surfaces;

means for sealing the space from the intake and the outlet openings;

means for advancing film in a downstream direction from the intake opening, through the space and to the outlet opening with the film emulsion facing the first surface;

means for heating the first platen to a temperature in the range of between about 150° F. to about 200° F;

at least one passageway formed in the first platen, in communication with the first surface and located proximate an upstream end thereof;

means for supplying the passageway with aqueous ammonia; and shallow groove means for permitting evaporation of the ammonia therein to effect a discharge of the ammonia from the passageway at only slightly above atmospheric pressure; whereby diazo film advanced through the space is contacted by ammonia vapor discharged from the passageway and causes the formation of a turbulent ammonia vapor layer between at least portions of the emulsion and the first surface to effect the rapid developing of the emulsion at relatively low temperatures and pressures.

14. Apparatus according to claim 13 including elongated transverse groove means in the first platen for distributing ammonia vapor discharged by the passageway over substantially the full width of the corresponding platen surface.

15. Apparatus according to claim 14 wherein the distribution means comprises a curved groove formed in the surface and communicating with the passageway.

16. Apparatus according to claim 15 wherein the groove has a longitudinal shape which is convex in the direction of film movement.

17. Apparatus according to claim 16 including a plurality of additional grooves in the first surface, downstream of the first mentioned groove, and also extending transversely across the width of the surface.

18. Apparatus according to claim 13 wherein the ammonia supplying means comprises pump means in fluid communication with a source of liquid ammonia and the passageway; means for sensing when a film approaches the space between the surfaces; and means operatively coupled with the sensing means and with the pump means for intermittently energizing the latter to supply a metered amount of liquid ammonia to the passageway for each film to be developed.

19. Apparatus according to claim 13, wherein the sealing means comprises sets of cooperating, elongate, opposite rollers disposed adjacent and parallel to the openings for receiving incoming film and discharging outgoing film, the rollers having resilient surfaces in mutual contact; low friction strip means sealingly disposed in corresponding grooves of the housing and arranged parallel to the rollers; and means resiliently biasing the strip means against the rollers so as to form a seal therewith and prevent the escape of ammonia vapors through the opening to the exterior.

20. Apparatus accoring to claim 19 including third and fourth platens defining a gap between them which is aligned with the space, the third and fourth platens being disposed between the first and second platens and the intake opening; and means for heating at least one of the third and fourth platens to effect a preheating of the film before it enters said space.

21. Apparatus according to claim 13 wherein the housing includes side walls extending beyond the first and second platens; a cover placed over the side walls and the first and second platens to confine the latter to the housing; and spring means disposed between the cover and an adjacent platen for biasing the latter against the other platen.

22. Apparatus according to claim 21 wherein the spring means comprises a plurality of angularly inclined leaf-spring means having an end secured to the cover and extending over a major portion of the width of the housing to effect drainage of condensed ammonia from the cover onto the platen and to prevent such condensed ammonia from contacting film passing through the housing.

* * * * *

UNITED STATES PATENT OFFICE

CERTIFICATE OF CORRECTION

Patent No. 4,255,037 Dated March 10, 1981

Inventor(s) John W. Meadows and Robert J. Ritter

It is certified that error appears in the above-identified patent and that said Letters Patent are hereby corrected as shown below:

Column 9, line 54, after "is" insert the following:

-- disposed transversely to the film movement direction and is --.

Signed and Sealed this

*Twenty-sixth* Day of *May 1981*

[SEAL]

*Attest:*

RENE D. TEGTMEYER

*Attesting Officer* *Acting Commissioner of Patents and Trademarks*